United States Patent [19]

Roberts et al.

[11] Patent Number: 4,739,225

[45] Date of Patent: Apr. 19, 1988

[54] REDUCED REQUIREMENT ENERGY STORAGE FOR LOAD HAVING NON-ZERO MINIMUM OPERATING POTENTIAL

[75] Inventors: Victor D. Roberts, Burnt Hills; Milton D. Bloomer, Scotia; George Jernakoff, Loudonville, all of N.Y.

[73] Assignee: General Electric Company, Schenectady, N.Y.

[21] Appl. No.: 925,894

[22] Filed: Nov. 3, 1986

[51] Int. Cl.[4] ..... H05B 37/00

[52] U.S. Cl. ..... 315/200 R; 315/209 M; 315/240; 315/246; 315/272; 315/273; 315/227 R; 315/241 R; 315/307; 315/308; 315/311; 315/310; 315/DIG. 5; 315/DIG. 7; 315/205; 363/37; 363/63; 363/74; 363/140

[58] Field of Search ..... 315/200 R, 209 M, 230, 315/232, 240, 272, 273, 307, 308, DIG. 5, DIG. 7, 205, 227 R, 241 R, 311, 310; 363/37, 45, 63, 74, 140

[56] References Cited

U.S. PATENT DOCUMENTS

| | | | |
|---|---|---|---|
| 4,042,856 | 8/1977 | Steigerwald | 315/307 |
| 4,109,307 | 8/1978 | Knoll | 315/DIG. 7 |
| 4,316,124 | 2/1982 | Verwimp et al. | 315/205 |
| 4,392,086 | 7/1983 | Ide et al. | 315/174 |
| 4,539,513 | 9/1985 | Ganser et al. | 315/DIG. 7 |

*Primary Examiner*—David K. Moore
*Assistant Examiner*—Michael J. Nickerson
*Attorney, Agent, or Firm*—Geoffrey H. Krauss; James C. Davis, Jr.; Marvin Snyder

[57] ABSTRACT

A load is provided, at all times when in operation, with a D.C. voltage having at least a minimum holding magnitude by: providing a source voltage having a peak magnitude greater than the holding magnitude; connecting the source voltage to the load only while the source voltage magnitude is greater than a preselected magnitude; charging from the peak source voltage magnitude an energy storage element while the load is connected to the source voltage; energizing the load from the charged energy storage element whenever the source voltage magnitude is less than the preselected magnitude; increasing the effective impedance of the load whenever the load is energized by the storage element; and selecting the energy storage element to provide at least the holding voltage to the load during each time interval when the energy storage element is connected to the load. An apparatus for providing a load voltage greater than a desired minimum voltage, but less than the peak voltage of a full-wave-rectified AC signal waveform, is described.

27 Claims, 2 Drawing Sheets

REDUCED REQUIREMENT ENERGY STORAGE FOR LOAD HAVING NON-ZERO MINIMUM OPERATING POTENTIAL

BACKGROUND OF THE INVENTION

The present invention relates to energy storage means and, more particularly, to novel means and method for operation of an energy storage element to maintain the voltage of a load above a required non-zero minimum voltage.

It is known that some types of electrical power-consuming loads, such as an arc discharge lamp and the like, require a DC load-energizing voltage having a magnitude which never decreases below a certain "holding" value; a load voltage less than the holding voltage can cause the load to cease operation in a desired mode, with potentially deleterious results. This minimum voltage requirement, in turn, places restraints upon both the manner of energy storage prior to the load and the method of operation of the energy storing means. Considering an arc discharge lamp load as an example, it is known that a metal halide lamp exhibits several modes of operation. In particular, most such discharge lamps pass first through a high-voltage breakdown mode and then through a glow mode, prior to commencing operation in the desired steady-state arc-discharge mode. If the arc current through the discharge lamp is interrupted for a sufficiently long time, which may be as short as 0.1 milliseconds, the discharge may be required to again pass through the glow mode, or possibly even through both the high-voltage breakdown mode and the glow mode, before arc mode operation is again possible. Additionally, discharge current interruption will allow the discharge impedance to increase, so that higher voltages must be applied to maintain the arc, even if the discharge is not returned to the glow mode. Therefore, a lamp-energizing ballast will preferably receive an operating potential which never falls below that potential at which the ballast can no longer properly energize the lamp and allows the lamp discharge to fall out of the desired arc mode of operation. In a co-pending U.S. application Ser. No. 659,754, filed Oct. 11, 1984, a ballast for an arc discharge lamp, operating from the direct current available from a full-wave-rectified AC source, utilized a capacitor for supplying lamp-energizing current when the rectified source voltage magnitude was less than the lamp load holding voltage. While this form of DC lamp-load ballast allowed a large value capacitance (e.g. about 50 microfarad) to be reduced to a lower value (e.g. about 10 microfarads), the capacitor is still of a size requiring the use of an electrolytic type, which is generally larger than desired for inclusion in a ballast compartment physically attached to the lamp itself, and also prevents the cost of the final lamp product from being reduced to a desired value. It is therefore highly desirable to provide both an energy storage capacitor-containing apparatus which can be used as a pre-ballast to supply energy to the actual ballast and thence to the lamp load, and a method for operating the pre-ballast apparatus to reduce the size of the energy storage capacitor when utilized with a controlled ballast energizing a load requiring a load voltage maintained greater than some minimum value, such as occurs with a ballasted metal-halide-type lamp load and the like.

BRIEF SUMMARY OF THE INVENTION

In accordance with the invention, a method for providing to a load, such as a lamp with a controllable ballast, at all times a D.C. voltage having at least a minimum holding magnitude, comprises the steps of: providing a source voltage having a peak magnitude greater than the holding magnitude; connecting the source voltage to the load only while the source voltage magnitude is greater than a selected substantially-constant reference voltage (which may be a fixed potential or a function of the lamp load voltage) with an amplitude not less than the holding magnitude; charging from the peak source voltage magnitude an energy storage element while the load is connected to the source voltage; connecting the charged energy storage element to the load whenever the source voltage is disconnected from the load; controlling the ballast to reduce the load current whenever the storage element is connected to the load; and selecting the energy storage element to provide at least the holding voltage to the load during each time interval when the energy storage element is connected to the load.

In a presently preferred embodiment, pre-ballast apparatus for providing a load voltage greater than a desired minimum voltage, but less than the peak voltage of a full-wave-rectified AC signal waveform, uses means, monitoring both the source and lamp voltages, for temporarily enabling a switching device to connect an energy storage means capacitor to the load whenever the source voltage is less than the minimum holding voltage. The rate of charge depletion from the storage capacitance is set by the decreased load current amplitude to which the ballast is controlled by changing the operating frequency and the like of a chopper means operating into an inductance. If the switching device is a FET, then the storage capacitors can be charged through the parasitic diode across the controlled-conduction circuit of the device.

Accordingly, it is one object of the present invention to provide a novel method for maintaining the voltage across a load at a value greater than a minimum holding value, even if the source voltage value is less than that holding value.

It is another object of the present invention to provide novel apparatus for maintaining the voltage across a load at a value greater than a minimum holding value, even if the source voltage value is less than that holding value.

These and other objects of the present invention will become apparent to those skilled in the art upon reading the following detailed description, when considered in conjunction with the drawings.

DETAILED DESCRIPTION OF THE INVENTION

Figure 1:
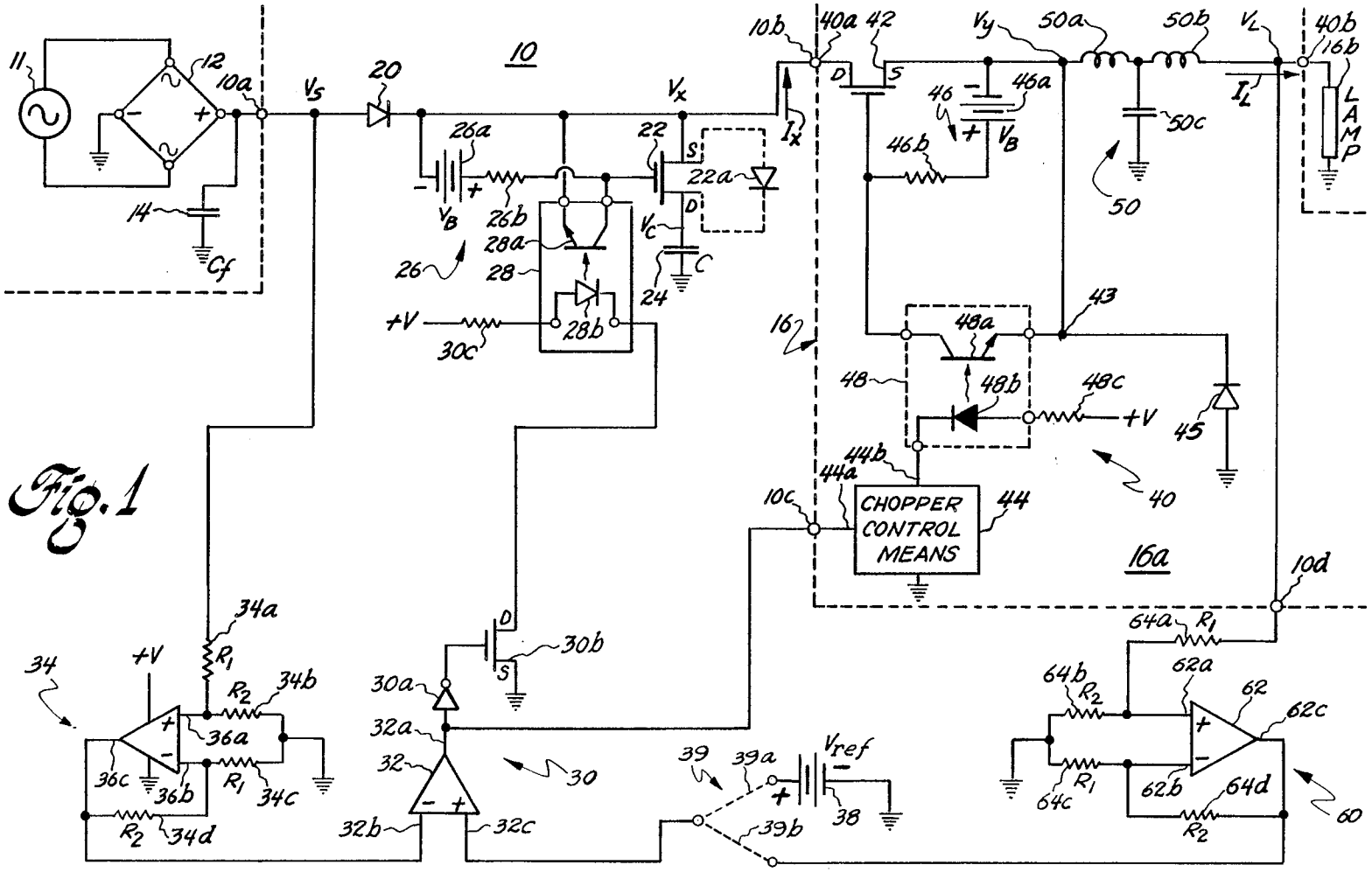
FIG. 1 is a schematic diagram of a presently preferred embodiment of pre-ballast apparatus utilizing the novel method of our invention for reducing the size of energy storage capacitance needed for operation of a load at a voltage greater than a known minimum voltage.

Referring initially to FIG. 1, pre-ballast apparatus 10 receives a DC signal voltage $V_S$ at an input 10*a* thereof, as provided from a AC signal source 11 by the full-wave-rectifying action of a full-wave bridge rectifier means 12 and a small filter capacitance 14, of capacitive value $C_f$ (e.g. about 0.22 microfarad, and the like). Apparatus 10 provides a voltage $V_x$ at an output terminal 10*b*, to a load 16 (a ballast 16*a* and a lamp 16*b*) which draws a "load" current $I_x$. The primary distinguishing characteristic of lamp 16*b* is the requirement for its energizing voltage to never be less than some minimum holding value, so that the ballast load input voltage $V_x$ is never less than a known minimum voltage $V_m$. Advantageously, load 16 (the ballasted lamp) may have a high power factor, such that the load appears to be substantially resistive. For purposes of illustration, lamp 16*b* will be a metal halide lamp, such as a GE HALARC TM lamp. Ballast 16*a* normally governs starting operation of the load current-control operation of the lamp; the ballast also controls (via a portion not shown) the starting operation of the lamp.

Apparatus 10 includes a unidirectionally-conducting element 20, such as a semiconductor diode and the like, so poled as to conduct when the input 10*a* source voltage $V_S$ is greater than the terminal 10*b* voltage $V_x$. A switching device 22, such as a field-effect transistor (FET) and the like, is connected in series with an energy storage means 24, between terminal 10*b* and the circuit common potential. Energy storage means 24 is preferably a capacitor with a capacitive value C. The FET device, which has its source electrode connected to terminal 10*b* and its drain electrode connected to capacitor 24, also has an integral parasitic diode element 22*a* formed between source and drain electrodes, so that the parasitic diode 22*a* is forward-biased whenever the ballasted load voltage $V_x$ is greater than the capacitor voltage $V_C$, thereby allowing charge to be added to the storage capacitor 24. (If a switching device 22 is used which does not have such a parasitic diode, an actual diode 22*a* will be required.) The switching device control element (here, the FET gate electrode) is biased, for enabling controlled-conduction or non-conduction in the controlled-current path of the device 22, by a control signal provided by a conduction signal circuit 26 between the gate and source electrodes of FET 22. Circuit 26 includes a bias potential $V_B$ source means 26*a* and a series resistor 26*b* between the gate and source electrodes, biasing device 22 normally into conduction; a controlled conduction shunt element, such as a phototransistor output element 28*a* in an opto-isolator means 2S, is connected between the control (gate) electrode and common (source) electrode of the switching means 22, to control that means to the non-conductive condition. Thus, FET 22 is in the non-conductive condition responsive to phototransistor 28*a* receiving photons from a photoemitter 28*b*, and is in the conductive condition responsive to a photoemitter 28*b* current flow of magnitude insufficient to place phototransistor 28*a* into the conductive condition. The emitter portion 28*b* of the isolation means 28 is itself energized by a control means 30. Control means 30 includes an inverter 30*a* which supplies the control (gate) signal to a switching FET device 30*b*, having its source electrode connected to circuit common potential and its drain electrode connected to the cathode of the photoemitter 28*b*. The series circuit, of FET 30*b* and photoemitter 28*b*, is completed by a current-limiting resistor 30*c* connected between a source of operating potential plus +V and the anode of the photoemitter element 28*b*.

A comparator 32 has an output 32*a* connected to the input of inverter 30*a*. An inverting first input 32*b* of the comparator is connected to the output of a first buffer amplifier means 34, which receives the source $V_S$ voltage from input 10*a*. This voltage is applied through a first resistive element 34*a*, of magnitude $R_1$, to a non-inverting first input 36*a* of a first operational amplifier 36. Input 36*a* is also connected through a second resistive element 36*b*, of resistance magnitude $R_2$, to circuit common potential. A third resistance element 34*c*, of the first resistance magnitude $R_1$, is connected between circuit common potential and the inverting second input 36*b* of the first operational amplifier; this input is also connected through a fourth resistive element 34*d*, of resistance magnitude $R_2$, to the first operational amplifier output 36*c*, which is itself connected to a comparator input 32*b*. The comparator non-inverting second input 32*c* is connected to a reference potential. This reference potential may be of essentially constant value $V_{ref}$, such as provided by a source 38, via a first jumper 39*a* of a connection means 39. The reference potential may be proportional to the actual lamp voltage $V_L$, if another jumper 39*b* is used instead of jumper 39*a*, as further described hereinbelow.

The pre-ballast apparatus 10 is used with ballast 16*a*, comprised of a chopper means 40, having a power input terminal 40*a* connected to pre-ballast output 10*b*, and an output 40*b* connected to load lamp 16*b*. In manner well known to the art, but not shown here, at least one of the lamp voltage and/or current are fed back to another input of means 40 (not shown for reasons of simplicity). The chopper uses a switching device 42, such as the illustrated power FET (which has a parasitic diode, not shown) with drain electrode connected to terminal 40*a* and source electrode connected to a node 43, at which a catching diode 45 is connected and a potential $V_y$ is formed. The conduction time intervals (duty cycle) of the chopper is controlled by any of the well-known chopper controls means 44, responsive to at least the binary level signal at input 44*a* from apparatus output 10*c*, at comparator output 32*a*. Thus, the selected periodic characteristic (frequency, pulse-width, etc) of the control means output 44*b* signal is at a first condition responsive to output 32*a* being at a low first level (indicated of the source voltage $V_S$ energizing the load) and is at a second condition responsive to output 32*a* being at a high second level (indicative of the storage capacitor voltage $V_c$ energizing the load). The control means output 44*b* signal is coupled to the control electrode (here, the gate) of chopper device 42. The control electrode is thus biased, for enabling controlled conduction or non-conduction in the controlled current path of device 42, by a control signal provided by a conduction signal circuit 46 between the gate and source electrodes of device 42. Circuit 46 includes another bias potential $V_B$ source means 46*a* and a series resistance 46*b* between the gate and source electrodes, biasing device 42 normally into conduction; a controlled-conduction shunt element, such as a phototransistor 48*a* of a second photoisolator means 48, is connected between the control (gate) electrode and the common (source) electrode of switching device 42, to control that device to the non-conductive condition. The photo-emitter 48*b*, of isolation 48, is connected, in series with a current-limiting resistance 48c, between operating potential +V and the chopper control means output 44b. The relatively high-frequency components of the chopped waveforms, at node 43, are reduced by a low-pass filter means 50; advantageously, the filter network has series inductive components 50a and 50b (along with a shunt capacitive component 50c) to allow the chopper output voltage $V_L$ to be boosted (if required) above voltage $V_x$, prior to application to load 16b. Thus, by action of the controlled ballast means 16a, the apparent impedance of the ballast/load combination 16 can be set such that a larger impedance (lower load current $I_x$) appears when the storage element supplies load energizing power, with respect to a lesser impedance (higher load current $I_x$) when the total load 16 is powered from the source voltage $V_S$.

The comparator second input is presently preferably connected via selected connection 39b to receive an attenuated version of the lamp voltage $V_L$ from the output of a second buffer amplifier means 60, receiving the lamp voltage $V_L$ signal at its input. This buffer amplifier means uses a second operational amplifier 62. A first resistance element 64a, of resistance value $R_1$, is connected between terminal 40b and the non-inverting first input 62a of the second operational amplifier. A second resistive element 64b, of resistance magnitude $R_2$, is connected between input 62a and circuit common potential. A third resistive element 64c, of first resistance value $R_1$, is connected between circuit common potential and an inverting second input 62b of operational amplifier 62. The second input is also connected through a fourth resistance element 64d, of magnitude $R_2$, to the amplifier output 62c, which provides the signal to comparator second input 32c.

Figure 2:
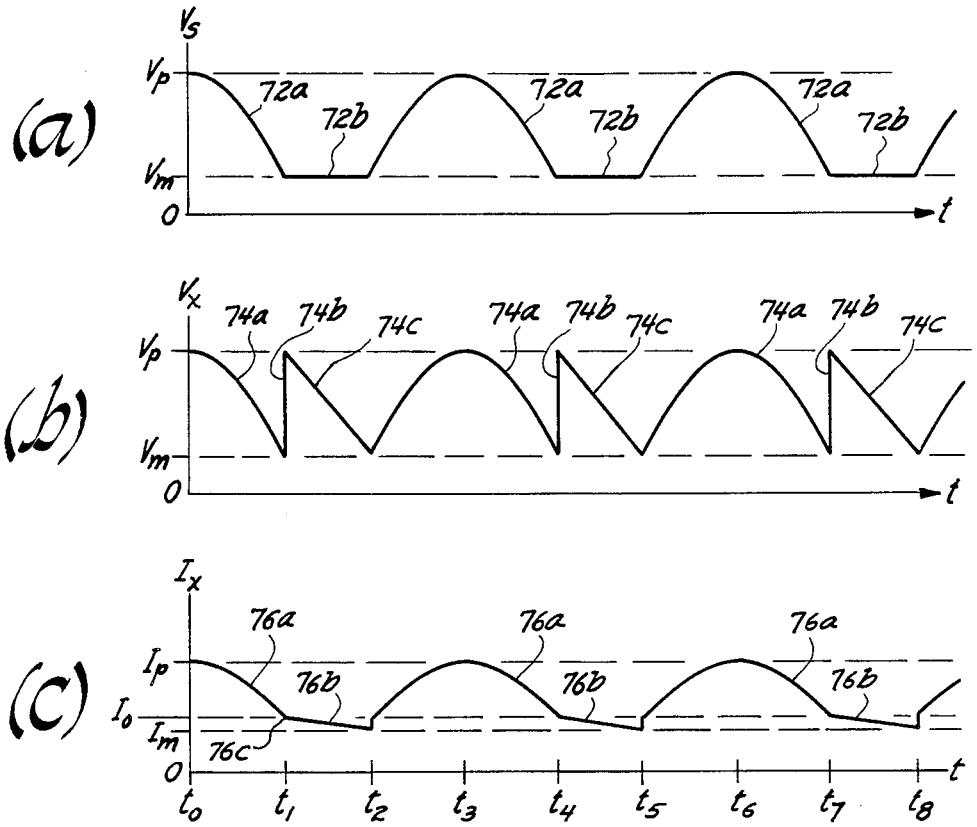
FIG. 2 is a set of time-synchronized graphs of the signals present in the circuit of FIG. 1, and useful in understanding the principles of operation thereof.

Referring now to both figures, our novel pre-ballast apparatus 10 operates with load 16 (ballast 16a and lamp 16b) in the following manner in accordance with the novel method of our present invention: the AC source signal waveform is full-wave-rectified to provide the source voltage $V_S$ as a sequence of semi-sinusoidally varying portions 72a with intermediate other portions 72b (waveform a of FIG. 2). Each of portions 72a lasts for somewhat less than the time interval for one half-cycle at the source frequency, i.e. less than 1/120 second for a 60 Hz. AC power line signal in the United States. Illustratively, the source voltage waveform is at the source peak voltage $V_P$ at time $t_0$. During signal portion 72a, the source voltage $V_S$ is greater than both the capacitor voltage $V_C$ and the total voltage $V_x$, such that diode 20 is forward-biased and conducts. The chopper control means input 44a is now receiving the first comparator output level (a low level) as the attenuated source voltage $V_S$ is greater than the attenuated voltage used as the comparator reference level. Therefore, the total voltage $V_x$ (waveform b of FIG. 2) has a first portion 74a which substantially follows the source voltage portion 72a in magnitude and shape. Because the illustrated lamp-ballast load has a high power factor, i.e. is substantially resistive, the total, or ballasted, load input current $I_x$ (waveform c of FIG. 2) has a first portion 76a which is also substantially sinusoidal and has a peak current magnitude $I_P$ substantially at time $t_0$. During this portion of the source waveform (from time $t_0$ to time $t_1$), switching device 22 is in the non-conductive condition, although the parallel parasitic diode 22a is forward biased and allows capacitor 24 to be charged, so that its voltage $V_c$ is equal to the peak voltage $V_P$. As the source voltage magnitude decreases in the time interval between time $t_0$ and time $t_1$, the decreasing source-load voltage becomes less than the peak voltage held across capacitor 24, so that parasitic diode 22a is reversed-biased and ceases to conduct. The load voltage continues to decrease as the source voltage decreases, while the buffered voltages at comparator inputs 32b and 32c respectively decrease. Each of buffers 34 and 38 acts as a constant attenuator, with the output voltage (at comparator input 32b or 32c, respectively) being respectively equal to $R_2/R_1$ times the input (source voltage $V_S$ or lamp voltage $V_L$, respectively). Summing up operation from time $t_o$ to time $t_1$: the source voltage is greater than the reference voltage; device 22 is off, and relatively high load current $I_x$ flows from the source.

At time $t_1$, the lamp voltage $V_L$ reference amplitude has become greater than the source voltage $V_S$ amplitude and the comparator output 32a changes state, to a high level. By action of inverter 30a, switching device 30b was in the conductive condition only when the comparator output is at the low level (e.g. when the source voltage amplitude is greater than the load voltage magnitude and diode 20 is conducting); now the flow of current through photoemitter device 28b ceases and thus causes phototransistor 28a to stop conducting. This allows turn-on of switching device 22, to connect capacitor 24 to ballast input 40a, only when the lamp voltage $V_L$ is instantaneously greater than the source voltage $V_S$. Simultaneously, the high level at chopper control means input 44a causes the chopper operation to change to a higher-impedance mode (e.g. narrows the chopper "on" pulse width, with constant pulse repetition frequency); the control can be preselected such that the instantaneously higher load voltage $V_p$ now applied to the ballast from the peak-voltage-charged capacitor 24, exactly at time $t_1$ (corresponding to leading edge portion 74b), still only draws the same load current $I_O$ at point 76c. During the remainder of the time period from time $t_1$ to $t_2$, device 22 remains in the conductive, or turned-on, condition and continues to connect energy storage capacitor 24 to output terminal 10b; the substantially peak $V_P$ voltage across storage capacitor 24 is now provided at terminal 10b and diode 20 is kept in the reverse-biased and nonconductive condition. Therefore, in each portion 72b, e.g. as between time $t_1$ and time $t_2$, the source voltage $V_s$ is substantially constant, as the small filter capacitor 14 is temporarily disconnected from terminal 10b (and all components attached thereto) by the reversed-biased non-conductive diode 20, and is also disconnected from the source 11 by the reversed-biased non-conductive diodes of bridge 12. Only the small bias current drawn through the relatively large magnitude $R_1$ of resistor 34a affects the magnitude of the source voltage portion 72b during this time interval. The load voltage $V_x$, during the same time interval from time $t_1$ to time $t_2$, has a leading edge portion 74b caused by the sudden increase in magnitude from the voltage $V_m$ (at terminal 10a immediately prior to a switching of FET device 22 into conduction) to the peak voltage $V_P$ across energy storage capacitor 24 immediately after device 22 conducts. Thereafter, and until time $t_2$, the load current is determined by both the storage capacitor voltage $V_C$ (which decreases in portion 44c, as the charge is drained from storage capacitor 24 at a rate dependent upon the load current $I_x$ portion 46b) and the total load impedance, which is effectively set by the higher-impedance mode of ballast chopper operation. As the load voltage $V_x$ decreases in portion 74c, the load current $I_x$ will also decrease in portion 76b, until a predetermined minimum load current $I_m$ is reached at time $t_2$. Summing up operation from time $t_1$ to time $t_2$: the load voltage $V_x$ is greater than the source voltage $V_S$; device 22 is on; and relatively low current flows from capacitor 24.

At time $t_2$, the now-increasing source voltage $V_S$ magnitude instantaneously exceeds the magnitude of the load voltage (which is then approximately the minimum holding voltage magnitude $V_m$), and the following events occur: diode 20 is now again forward-biased into conduction, so that the load voltage $V_x$ increasing portion 74a follows the increasing source voltage $V_S$ portion 72a; and the signal magnitude at comparator second input 32c becomes less than the signal magnitude at comparator input 32b, such that comparator output 32a is again switched to the low logic level, to (a) turn on switching device 30b, thus removing drive from switching device 22, and (b) switch the chopper means, via chopper control means 44, into low-impedance mode. As the load voltage increases, towards the source voltage peak amplitude $V_P$, the parasitic diode 22a is forward-biased into conduction to recharge energy storage capacitor 24 to the peak $V_P$ amplitude. Thus, at time $t_3$ the storage capacitor voltage $V_C$ is again at peak voltage $V_P$. Capacitor voltage $V_c$ remains substantially equal to the peak voltage $V_P$ while the source and load voltages decrease toward time $t_4$, when the comparator output will again switch to a high level and enable switching device 22 into conduction, to cause the load to be energized, for the short time interval from time $t_4$ to time $t_5$, by a voltage greater than the holding voltage, although at a power level less than the normal operating power of the lamp. If the energy storage means 24 discharge time interval is approximately one third of each source waveform half-cycle, as would occur with a load requiring a minimum voltage of about 85 volts (with a halide lamp of about 40 watts power rating having an integral ballast means 16b with controlled high-impedance state such that the minimum current is about 50 milliamperes) and a peak voltage of about 170 volts (in a 120 volt RMS AC system), the preballast energy storage capacitor 24 can have a capacitive magnitude C on the order of one-quarter microfarad. The capacitance $C_f$ of filter capacitance 14 can also be on the order of one-quarter microfarad. Therefore, not only the entire preballast apparatus 10, but also the diode bridge 12 and filter capacitor 14, can be made small enough to be placed in the same compartment of the load as occupied by ballast 16a, as the two capacitors 14 and 24 can now be relatively small, temperature-stable and inexpensive film capacitors and the like.

While one presently preferred embodiment of the pre-ballast apparatus utilizing the method of the present invention has been described herein, many variations and modifications will now become apparent to those skilled in the art. It is our intent, therefore, to be limited only by the scope of the appending claims and not by the specific details or instrumentalities presented by way of explanation by way of the preferred embodiment described herein.

What is claimed is:

1. A method for providing to a load, at all times when the load should be energized, a D.C. voltage having at least a predetermined holding magnitude, from a varying source voltage having a respective peak and minimum magnitudes respectively greater than and less than the holding voltage, comprising the steps of:

(a) connecting the source voltage to the load only when the source voltage magnitude is greater than a preselected load voltage magnitude obtained by attenuating the load voltage;

(b) charging an energy storage element to a voltage peak magnitude greater than the load holding magnitude, while the load is connected to the source voltage;

(c) attenuating the source voltage magnitude to provide a first signal, and then continuously comparing the first signal and the preselected load voltage magnitude signal to energize the load from the charged storage element whenever the source voltage magnitude is less than the preselected magnitude;

(d) increasing the effective impedance of the load whenever the load is energized by the charged storage element; and (e) selecting the characteristics of the energy storage element to provide at least the holding voltage to the load during the entirety of each time interval when the energy storage element is connected to the load.

2. The method of claim 1, wherein step (c) includes the steps of: providing a switching device in series between the energy storage element and the load; and enabling the switching device into conduction whenever the source voltage is not greater than the preselected load voltage magnitude.

3. The method of claim 2, wherein the energy storage element is a capacitor.

4. The method of claim 3, wherein step (d) includes the step of increasing the load impedance by an amount sufficient to cause the load to require a known minimum current; and step (e) includes the step of selecting the storage capacitor to have a capacitance value sufficient to provide at least the minimum current during each time interval.

5. The method of claim 4, wherein step (d) includes the step of selecting the effective impedance of the load, in conjunction with the capacitance value of the storage capacitor, to provide at least the holding voltage to the load at the end of each time interval when the load is connected to the capacitor.

6. The method of claim 1, wherein step (a) includes the steps of: providing a unidirectionally-conducting element in series between the source voltage and the load; and poling the unidirectional element to conduct only when the source voltage magnitude is greater than the load voltage magnitude.

7. The method of claim 6, wherein step (a) also includes the step of allowing the unidirectional element to conduct only when the storage element is not effectively connected to provide operating potential to the load.

8. The method of claim 1, wherein step (b) includes the steps of: providing a unidirectionally-conducting element in series between the source voltage and the storage element; and poling the unidirectional element to conduct only when the source voltage magnitude is greater than the storage element voltage magnitude.

9. The method of claim 1, further comprising the steps of: obtaining a periodically-varying signal from an A.C. source with a peak magnitude greater than the holding magnitude; and full-wave rectifying the A.C. signal to provide the source voltage.

10. The method of claim 9, further comprising the step of filtering the full-wave-rectified A.C. signal to prevent any portion thereof having an essentially zero magnitude.

11. Apparatus for providing to a lamp, at all times when the lamp should be energized, a D.C. voltage having at least a predetermined holding magnitude, from a varying source voltage having respective peak and minimum magnitudes respectively greater than and less than the holding voltage, comprising:

ballast means for energizing the lamp; said ballast means having a control input and a power input with an effective impedance controllable between high and low impedances respective to different levels of a binary signal at said control input;

means for connecting the source voltage to the ballast means power input only when the source voltage magnitude is greater than a preselected magnitude;

an energy storage element;

means for charging, while the ballast means power input is connected to the source voltage, the energy storage element to a voltage peak magnitude sufficiently large to cause the ballast means to provide the lamp with a voltage greater than the lamp holding magnitude;

means for connecting the charged storage element to the ballast means power input whenever the source voltage is less than the preselected magnitude and for providing at said ballast means control input that binary signal level required to cause said ballast means effective impedance to be at the high impedance whenever said energy storage element is connected to the ballst means power input;

said energy storage element providing at least the holding voltage to the load during the entirety of each time interval when the energy storage element is connected to the load.

12. The apparatus of claim 11, wherein the energy storage element is a capacitor.

13. The apparatus of claim 12, wherein the charging means comprises a unidirectionally-conducting element connected between said ballast means power input and said capacitor and poled to conduct only if the source voltage magnitude is greater than the magnitude of the voltage across said capacitor.

14. The apparatus of claim 13, wherein the source voltage connecting means comprises a undirectionally-conducting element, poled to conduct only if the source voltage magnitude is greater than the voltage magnitude at the ballast means power input.

15. The apparatus of claim 14, wherein the storage element connecting means comprises a switching device having a controlled-conduction circuit in series connection between the storage capacitor and the ballast means power input, and a control electrode at which reception of a control signal causes the controlled circuit to substantially connect said capacitor and said load.

16. The apparatus of claim 15, wherein said ballast means effective high impedance is substantially resistive and of a magnitude selected, in conjunction with the capacitance of said capacitor, to provide at least the holding voltage to the ballast means power input at the end of each time interval when the load is connected to the capacitor.

17. The apparatus of claim 15, wherein the switching device is a field-effect transistor having its source-drain circuit connected between the capacitor and the ballast means power input.

18. The apparatus of claim 17, wherein the charging means element is a diode connected in parallel with the source-drain circuit of the switching FET.

19. The apparatus of claim 15, wherein the storage element connecting means further comprises: first means for providing a first signal with magnitude responsive to the instanteous magnitude of said source voltage; second means for providing a second signal with magnitude responsive to the instanteous magnitude of said lamp voltage; means for comparing the magnitudes of said first and second signals; and means for providing the control signal whenever the lamp voltage magnitude is not less than the source voltage magnitude.

20. Apparatus for providing to a load, having a control input and a power input with an effective impedance controllable between high and low impedances responsive to different levels of a binary signal at said control input, at all times when the load should be energized, a D.C. voltage having at least a predetermined holding magnitude, from a varying source voltage having respective peak and minimum magnitudes respectively greater than and less than the holding voltage, comprising:

means for connecting the source voltage to the load power input only when the source voltage magnitude is greater than a preselected magnitude;

an energy storage element;

means for charging, while the load power input is connected to the source voltage, the energy storage element to a voltage peak magnitude sufficiently large to provide the load with a voltage grater than the load holding magnitude;

means for connecting the charged storage element to the load power input whenever the source voltage is less than the preselected magnitude and for providing at said load control input that binary signal level required to cause said load effective impedance to be at the high impedance whenever said energy storage element is connected to the load power input;

said energy storage element providing at least the holding voltage to the load during the entirety of each time interval when the energy storage element is connected to said load.

21. The apparatus of claim 20, wherein the energy storage element is a capacitor.

22. The apparatus of claim 21, wherein the charging means comprises a unidirectionally-conducting element connected between said load power input and said capacitor and poled to conduct only if the source voltage magnitude is greater than the magnitude of the voltage across said capacitor.

23. The apparatus of claim 22, wherein the source of voltage connecting means comprises a unidirectionally-conducting element, poled to conduct to conduct only if the source voltage magnitude is greater than the voltage magnitude at the load power input.

24. The apparatus of claim 23, wherein the storage element connecting means comprises a switching device having a controlled-conduction circuit in series connection between the storage capacitor and the load power input, and a control electrode at which reception of a control signal causes the controlled circuit to substantially connect said capacitor and said load.

25. The apparatus of claim 24, wherein said load effective high impedance is substantially resistive and of a magnitude selected, in conjunction with the capacitance of said capacitor, to provide at least the holding voltage to the load power input at the end of each time interval when the load is connected to the capacitor.

26. The apparatus of claim 24, wherein the switching device is a field-effect transistor having its source-drain circuit connected between the capacitor and load power input.

27. The apparatus of claim 26, wherein the charging means element is a diode connected in parallel with the source-drain circuit of the switching FET.

* * * * *